US009916817B2

(12) United States Patent
Chen et al.

(10) Patent No.: US 9,916,817 B2
(45) Date of Patent: Mar. 13, 2018

(54) DISPLAY METHOD OF DISPLAY PANEL, DISPLAY PANEL AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Zhongjun Chen, Beijing (CN); Peng Liu, Beijing (CN); Pengcheng Lu, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 114 days.

(21) Appl. No.: 14/740,741

(22) Filed: Jun. 16, 2015

(65) Prior Publication Data

US 2016/0203800 A1 Jul. 14, 2016

(30) Foreign Application Priority Data

Jan. 13, 2015 (CN) ..... 2015 1 0016370

(51) Int. Cl.

| | |
|---|---|
| ***G09G 5/00*** | (2006.01) |
| ***G09G 5/391*** | (2006.01) |
| ***G09G 5/02*** | (2006.01) |
| ***G09G 3/20*** | (2006.01) |

(52) U.S. Cl.

CPC ..... *G09G 5/391* (2013.01); *G09G 3/2003* (2013.01); *G09G 5/02* (2013.01); *G09G 5/005* (2013.01); *G09G 2300/0452* (2013.01); *G09G 2320/02* (2013.01); *G09G 2340/0407* (2013.01); *G09G 2340/0457* (2013.01)

(58) Field of Classification Search

CPC ..... G09G 3/22; G09G 3/3208; G09G 3/30; G09G 3/3225; G09G 3/3233; G09G 3/3241; G09G 3/3266; G09G 3/3275; G09G 3/3258

See application file for complete search history.

(56) References Cited

U.S. PATENT DOCUMENTS 5,311,337 A * 5/1994 McCartney, Jr. . G02F 1/133514 349/109
6,714,206 B1 * 3/2004 Martin ..... G09G 3/2003 345/589

(Continued)

*Primary Examiner* — Kent Chang
*Assistant Examiner* — William Lu
(74) *Attorney, Agent, or Firm* — Nath, Goldberg & Meyer; Joshua B. Goldberg

(57) ABSTRACT

The present invention relates to a display method of a display panel, a display panel and a display device, and the display method of a display panel is used for enabling each row of N pixel units in the display panel to display an image having 2N+x−1 pixel points. The display method comprises steps of: acquiring an image, each row of which comprises 2N+x−1 pixel points corresponding to the N pixel units; and determining a display parameter of each sub-pixel according to the components, which have the same color as the sub-pixel, in the pixel points corresponding to the sub-pixel.

20 Claims, 4 Drawing Sheets

(56) References Cited

U.S. PATENT DOCUMENTS 6,950,115 B2 * 9/2005 Brown Elliott ..... G09G 3/2003 345/694
7,045,963 B2 * 5/2006 Chen ..... H01J 11/12 313/582
7,728,802 B2 * 6/2010 Brown Elliott ..... G09G 3/3607 345/694
9,576,519 B2 * 2/2017 Guo ..... G09G 3/2003
9,824,620 B2 * 11/2017 Guo ..... G09G 3/2074
2002/0063729 A1 * 5/2002 Ooe ..... G09G 3/2029 345/694
2002/0070909 A1 * 6/2002 Asano ..... G09G 3/3233 345/76
2002/0126074 A1 * 9/2002 Ouellette ..... G09G 3/20 345/87
2002/0140713 A1 * 10/2002 Klompenhouwer . G09G 3/2003 345/690
2003/0034992 A1 * 2/2003 Brown Elliott ..... G06T 3/4015 345/690
2003/0117423 A1 * 6/2003 Brown Elliott ..... G09G 3/20 345/690
2004/0212633 A1 * 10/2004 Natori ..... G09F 9/33 345/694
2005/0140634 A1 * 6/2005 Takatori ..... G09G 3/3655 345/96
2005/0225563 A1 * 10/2005 Brown Elliott ..... G09G 5/02 345/604
2008/0002137 A1 * 1/2008 Kim ..... G02F 1/1303 349/187
2008/0030660 A1 * 2/2008 Roth ..... G09G 3/3607 349/106
2008/0170083 A1 * 7/2008 Han ..... G09G 5/377 345/589
2010/0045695 A1 * 2/2010 Brown Elliott ..... G09G 3/2003 345/589
2011/0273494 A1 * 11/2011 Jun ..... G09G 3/2003 345/694
2013/0002118 A1 * 1/2013 Ko ..... H01L 27/3216 313/1
2013/0038513 A1 * 2/2013 Park ..... H01L 27/3218 345/55
2013/0113363 A1 * 5/2013 Hong ..... H01L 27/3218 313/498
2014/0071175 A1 * 3/2014 Yang ..... G09G 3/3208 345/690
2015/0015466 A1 * 1/2015 Feng ..... G09G 3/2003 345/77

* cited by examiner

DISPLAY METHOD OF DISPLAY PANEL, DISPLAY PANEL AND DISPLAY DEVICE

FIELD OF THE INVENTION

The present invention relates to the field of display technology, and particularly relates to a display method of a display panel, a display panel and a display device.

BACKGROUND OF THE INVENTION

In the field of display technology, people continue to pursue higher display quality. An important aspect to improve display quality of a display panel is to enable a display panel having a certain size to display an image with higher resolution.

In the prior art, generally, by increasing pixel density of a display panel, i.e., preparing more pixel units per unit area of the display panel, the display panel is able to display an image with higher resolution. However, with continuous increase in pixel density of a display panel, it becomes more and more difficult to continuously increase the pixel density of a display panel due to the limitation of the existing process conditions. As such, how to enable a display panel to display an image with higher resolution without increasing the pixel density thereof has become an urgent problem to be solved in the art.

SUMMARY OF THE INVENTION

Embodiments of the present invention provide a display method of a display panel, a display panel and a display device. The display method of a display panel can enable a display panel to display an image with higher resolution without increasing the pixel density of the display panel.

According to an aspect of the present invention, there is provided a display method of a display panel, the display panel comprises a plurality of pixel units arranged in M rows and N columns, each pixel unit comprising x sub-pixels $A_1 \sim A_x$ with different colors, wherein M, N and x satisfy $M \geq 1$, $N \geq 1$ and $x \geq 3$, respectively, and the display method enables each row of N pixel units in the display panel to display an image having $2N+x-1$ pixel points. The display method comprises steps of: S1, acquiring an image, each row of which comprises $2N+x-1$ pixel points corresponding to the N pixel units, wherein each pixel point comprises x components having different colors, and the x colors are the same colors as those of the x sub-pixels $A_1 \sim A_x$, respectively; and S2, determining a display parameter of each sub-pixel according to the components, which have the same color as the sub-pixel, in the pixel points corresponding to the sub-pixel. The pixel points corresponding to each sub-pixel are two adjacent pixel points in the acquired image, any two sub-pixels having the same color correspond to different pixel points, the sub-pixels having the same color in any two adjacent pixel units correspond to four consecutive pixel points, and in each pixel unit, any two adjacent sub-pixels share one pixel point to which both of said two adjacent sub-pixels correspond.

According to an embodiment of the present invention, $M \geq 2$, $N \geq 2$, and a plurality of sub-pixels in the same column are aligned in a column direction.

According to an embodiment of the present invention, the two pixel points corresponding to the sub-pixel $A_y$ in the pixel unit in column n are the pixel point in column $2n+y-2$ and the pixel point in column $2n+y-1$, respectively, wherein, $1 \leq n \leq N$ and $1 \leq y \leq x$.

According to an embodiment of the present invention, $M \geq 2$, $N \geq 2$, in an odd-numbered row, the two pixel points corresponding to the sub-pixel $A_y$ in the pixel unit in column n are the pixel point in column $2n+y-2$ and the pixel point in column $2n+y-1$, respectively, and in an even-numbered row, the two pixel points corresponding to the sub-pixel $A_y$ in the pixel unit in column n are the pixel point in column $2n+y-2+t$ and the pixel point in column $2n+y-1+t$, respectively; or, in an even-numbered row, the two pixel points corresponding to the sub-pixel $A_y$ in the pixel unit in column n are the pixel point in column $2n+y-2$ and the pixel point in column $2n+y-1$, respectively, and in an odd-numbered row, the two pixel points corresponding to the sub-pixel $A_y$ in the pixel unit in column n are the pixel point in column $2n+y-2+t$ and the pixel point in column $2n+y-1+t$, respectively, wherein $1 \leq n \leq N$, $1 \leq y \leq x$ and $t \geq 1$.

According to an embodiment of the present invention, a plurality of sub-pixels in the same column in odd-numbered rows are aligned in a column direction, a plurality of sub-pixels in the same column in even-numbered rows are aligned in the column direction, and the sub-pixels in the same column in any two adjacent rows are staggered in the column direction.

According to an embodiment of the present invention, the sub-pixels in the same column in any two adjacent rows are staggered, in the column direction, by ½ the width of the pixel unit.

According to an embodiment of the present invention, a spare region at a side of the even-numbered row between two adjacent odd-numbered rows is provided with a supplementary display unit, and/or, a spare region at a side of the odd-numbered row between two adjacent even-numbered rows is provided with a supplementary display unit, wherein, the supplementary display unit comprises one or more sub-pixels.

According to an embodiment of the present invention, aspect ratio of each sub-pixel is 3:2.

According to another aspect of the present invention, there is provided a display panel, which comprises a plurality of pixel units arranged in M rows and N columns, each pixel unit comprising x sub-pixels $A_1 \sim A_x$ with different colors, wherein M, N and x satisfy $M \geq 1$, $N \geq 1$ and $x \geq 3$, respectively. The display panel further comprises an image acquiring unit, a distribution unit, a display parameter calculating unit and a driving unit. The image acquiring unit is configured to acquire an image, each row of which has $2N+x-1$ pixel points, each of which comprises x components having different colors, and the x colors are the same colors as those of the x sub-pixels $A_1 \sim A_x$, respectively. The distribution unit is configured to distribute the $2N+x-1$ pixel points in each row to the sub-pixels in the same row of N pixel units in the display panel so that each sub-pixel corresponds to two pixel points, any two sub-pixels having the same color correspond to different pixel points, the sub-pixels having the same color in any two adjacent pixel units correspond to four consecutive pixel points, and in each pixel unit, any two adjacent sub-pixels share one pixel point to which both of said two adjacent sub-pixels correspond. The display parameter calculating unit is configured to determine a display parameter of each sub-pixel according to the components, which have the same color as the sub-pixel, in the pixel points corresponding to the sub-pixel. The driving unit is configured to input a driving signal to each sub-pixel such that each sub-pixel displays according to the display parameter determined by the display parameter calculating unit.

According to still another aspect of the present invention, there is provided a display device comprising a display panel, which comprises a plurality of pixel units arranged in M rows and N columns, each pixel unit comprising x sub-pixels $A_1 \sim A_x$ with different colors, wherein M, N and x satisfy $M \geq 1$, $N \geq 1$ and $x \geq 3$, respectively. The display panel further comprises an image acquiring unit, a distribution unit, a display parameter calculating unit and a driving unit. The image acquiring unit is configured to acquire an image, each row of which has 2N+x−1 pixel points, each of which comprises x components having different colors, and the x colors are the same colors as those of the x sub-pixels $A_1 \sim A_x$, respectively. The distribution unit is configured to distribute the 2N+x−1 pixel points in each row to the sub-pixels in the same row of N pixel units in the display panel such that each sub-pixel corresponds to two pixel points, any two sub-pixels having the same color correspond to different pixel points, the sub-pixels having the same color in any two adjacent pixel units correspond to four consecutive pixel points, and in each pixel unit, any two adjacent sub-pixels share one pixel point to which both of said two adjacent sub-pixels correspond. The display parameter calculating unit is configured to determine a display parameter of each sub-pixel according to the components, which have the same color as the sub-pixel, in the pixel points corresponding to the sub-pixel. The driving unit is configured to input a driving signal to each sub-pixel such that each sub-pixel displays according to the display parameter determined by the display parameter calculating unit.

According to embodiments of the present invention, each sub-pixel of the display panel correspondingly displays components having the same color as the sub-pixel in two adjacent pixel points, and the same row of N pixel units in the display panel can display an image having 2N+x−1 pixel points in each row, and thus the display panel can display an image with higher resolution without increasing the pixel density of the display panel. In addition, according to embodiments of the present invention, realization of displaying an image with higher resolution does not rely on increase in pixel density of a display panel, which will not result in increased output lines of a driving chip of the display panel or increased manufacturing cost of the display panel.

BRIEF DESCRIPTION OF THE DRAWINGS

Accompanying drawings, which constitute a part of the specification, are used for providing further understanding of the present invention and explaining the present invention in conjunction with the following specific implementations, rather than limiting the present invention. In the drawings.

DETAILED DESCRIPTION OF THE EMBODIMENTS

The specific implementations of the present invention will be described in detail below in conjunction with the accompanying drawings. It should be understood that, the specific implementations described herein are merely used for describing and explaining the present invention, rather than limiting the present invention.

Figure 1:
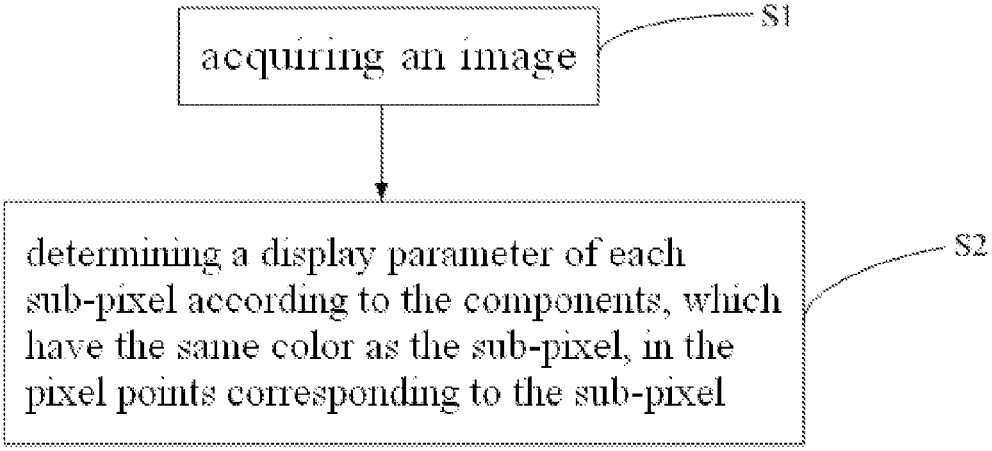
FIG. 1 is a flowchart of a display method of a display panel according to an embodiment of the present invention.
Figure 2:
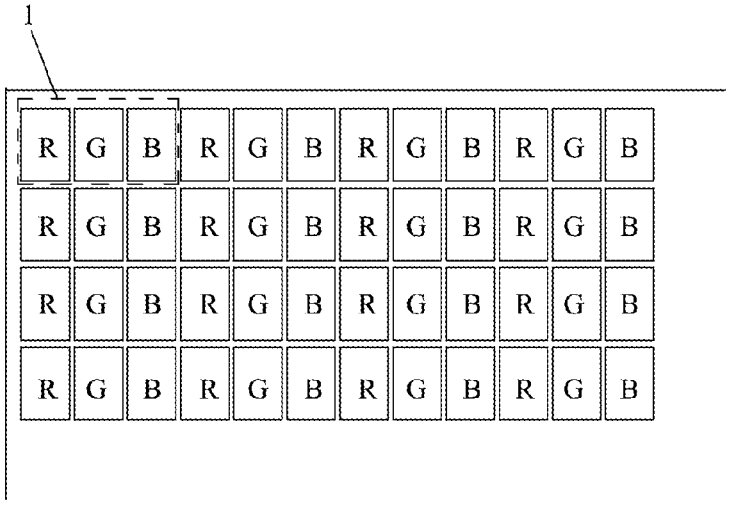
FIG. 2 is a schematic diagram of a display panel according to an embodiment of the present invention.

Referring to FIGS. 1 and 2, FIG. 1 is a flowchart of a display method of a display panel according to an embodiment of the present invention, and FIG. 2 is a schematic diagram of a display panel according to an embodiment of the present invention. According to the embodiment, the display panel may comprise a plurality of pixel units 1 arranged in M rows and N columns, each pixel unit 1 comprises x sub-pixels $A_1 \sim A_x$ with different colors, and M, N and x satisfy $M \geq 1$, $N \geq 1$ and $x \geq 3$, respectively. The display method enables each row of N pixel units 1 in the display panel to display an image S having 2N+x−1 pixel points 2. The display method comprises steps as follows.

An image S is acquired (step S1), each row of the image S comprises 2N+x−1 pixel points 2 corresponding to the N pixel units 1, each pixel point 2 comprises x components having different colors, and the x colors are the same colors as those of the x sub-pixels $A_1 \sim A_x$, respectively. The so-called "component" may be represented by brightness value of a color, or may be represented in other way such as grayscale, saturation or the like.

A display parameter of each sub-pixel is determined according to the components, which have the same color as the sub-pixel, in the pixel points 2 corresponding to the sub-pixel (step S2). According to an embodiment of the present invention, the display parameter of a sub-pixel may be the average value of the components, which have the same color as the sub-pixel, in the pixel points 2 corresponding to the sub-pixel.

The pixel points 2 corresponding to each sub-pixel are two adjacent pixel points 2 in the image S, any two sub-pixels having the same color correspond to different pixel points 2, the sub-pixels having the same color in any two adjacent pixel units 1 correspond to four consecutive pixel points 2, and in each pixel unit 1, any two adjacent sub-pixels share one pixel point 2 to which both of said two adjacent sub-pixels correspond.

In display driving, a corresponding driving signal is input to each sub-pixel according to the display parameter of the sub-pixel determined in step S2 such that each sub-pixel displays according to the determined display parameter.

In the embodiment, each pixel unit 1 comprises three sub-pixels having different colors (i.e., x=3). For example, colors of the three sub-pixels A1, A2 and A3 may be red, green and blue, respectively. However, it should be noted that, the present embodiment is exemplary only, and is not intended to limit the concept of the present invention. In specific applications, each pixel unit 1 in the display panel may have more than three sub-pixels, and each sub-pixel may have a color other than red, green and blue.

Figure 3:
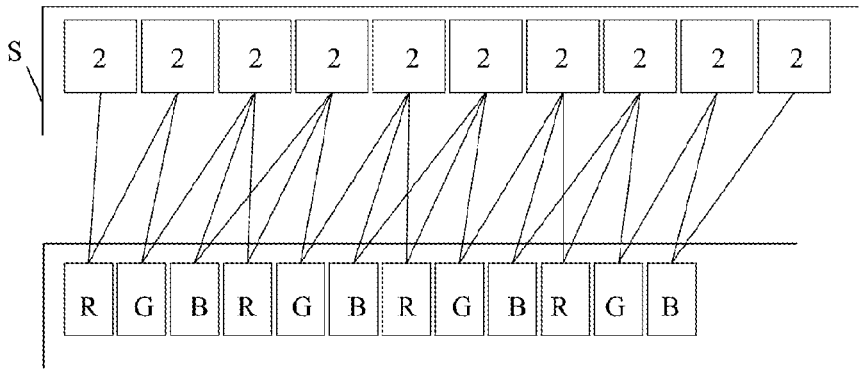
FIG. 3 is a schematic diagram illustrating correspondence between N pixel units in one row and 2N+x−1 pixel points of an image.

The display method according to the present embodiment can enable the N pixel units 1 in one row to display an image S having 2N+2 pixel points 2. FIG. 3 is a schematic diagram illustrating correspondence between N pixel units in one row and 2N+x−1 pixel points of an image. Referring to FIG. 3, there are four pixel units 1 in the row (i.e., N=4), and each pixel unit 1 comprises three sub-pixels A1, A2 and A3 (i.e., x=3). Each sub-pixel corresponds to two adjacent pixel points 2 in the image S, that is, each sub-pixel is configured to display components, which have the same color as said sub-pixel, in the two adjacent pixel points 2 corresponding thereto. For example, each red sub-pixel A1 is capable of displaying red components in two adjacent pixel points 2, each green sub-pixel A2 is capable of displaying green components in two adjacent pixel points 2, and each blue sub-pixel A3 is capable of displaying blue components in two adjacent pixel points 2.

In addition, in the pixel units 1 in the row, any two sub-pixels having the same color correspond to different pixel points 2, and the sub-pixels having the same color in any two adjacent pixel units 1 correspond to four consecutive pixel points 2. That is to say, the pixel points 2 corresponding to one red sub-pixel A1 are different from the pixel points 2 corresponding to another one red sub-pixel A1, and in two adjacent pixel units, the two pixel points 2 corresponding to the red sub-pixel A1 in the former pixel unit 1 and the two pixel points 2 corresponding to the red sub-pixel A1 in the latter pixel unit 1 are four consecutive pixel points 2. The green sub-pixels A2 and blue sub-pixels A3 are similar to the red sub-pixels A1, and are not repeated.

Besides, in each pixel unit 1, any two adjacent sub-pixels share one pixel point 2 to which both of them correspond. As shown in FIG. 3, the two pixel points 2 corresponding to the red sub-pixel A1 and the two pixel points 2 corresponding to the green sub-pixel A2 adjacent thereto have one pixel point 2 in common, and the two pixel points 2 corresponding to the green sub-pixel A2 and the two pixel points 2 corresponding to the blue sub-pixel A3 adjacent thereto have one pixel point 2 in common.

It can be thus known that, among N pixel units 1 in one row, the pixel points 2 corresponding to the respective red sub-pixels A1 are sequentially the first and the second pixel points 2, the third and the fourth pixel points 2, the fifth and the sixth pixel points 2, . . . , and the (2N−1)th and the 2Nth pixel points 2, the pixel points 2 corresponding to the respective green sub-pixels A2 are sequentially the second and the third pixel points 2, the fourth and the fifth pixel points 2, the sixth and the seventh pixel points 2, . . . , and the 2Nth and the (2N+1)th pixel points 2, and the pixel points 2 corresponding to the respective blue sub-pixels A3 are sequentially the third and the fourth pixel points 2, the fifth and the sixth pixel points 2, the seventh and the eighth pixel points 2, . . . , and the (2N+1)th and the (2N+2)th pixel points 2.

Thus, it can be obtained that, the number of the pixel points 2 corresponding to the sub-pixels in the N pixel units 1 in one row is 2N+2. As shown in FIG. 3, each of the third to the 2Nth pixel points 2 corresponds to the red sub-pixel A1, the green sub-pixel A2 and the blue sub-pixel A3 simultaneously, the first pixel point 2 corresponds to the red sub-pixel A1 only, the second pixel point 2 corresponds to the red sub-pixel A1 and the green sub-pixel A2, the (2N+1)th pixel point 2 corresponds to the green sub-pixel A2 and the blue sub-pixel A3, and the (2N+2)th pixel point 2 corresponds to the blue sub-pixel A3 only. It can be easily understood that, the color components in the third to the 2Nth pixel points 2 can be completely displayed by the N pixel units 1 in the row, while for the first, the second, the (2N+1)th and the (2N+2)th pixel points 2, the color components included therein are partially displayed by the N pixel units 1 in the row.

In summary, the N pixel units 1 in one row display the color components of 2N+2 pixel points 2, and can thus display an image S having 2N+2 pixel points in one row.

The present embodiment shows the example in which each pixel unit 1 comprises three sub-pixels, and describes the principle of displaying, by N pixel units 1 in one row, the image S having 2N+2 pixel points in one row in detail. It can be deduced from the present embodiment that, when each pixel unit 1 comprises x sub-pixels, the N pixel units 1 in one row can display an image S having 2N+x−1 pixel points in one row, based on the display method of the embodiment of the present invention. The first to the (x−1)th pixel points 2 correspond to one sub-pixel, two sub-pixels, . . . and x−1 sub-pixels, respectively, each of the xth to the 2Nth pixel points corresponds to x sub-pixels, and the (2N+1)th to the (2N+x−1)th pixel points 2 correspond to x−1 sub-pixels, x−2 sub-pixels, . . . , and one sub-pixel, respectively. That is to say, when the N pixel units 1 in one row display, they not only display all color components included in the 2N+x−1 pixel points 2, but also display a part of the color components included in the 2x−2 pixel points 2. Therefore, the N pixel units 1, each of which comprises x sub-pixels having different colors, in one row can display an image having 2N+x−1 pixel points 2 in one row.

In the display method according to the present embodiment, by enabling each sub-pixel of the display panel to correspondingly display components having the same color as the sub-pixel in two adjacent pixel points 2, and enabling the same row of N pixel units in the display panel to display an image having 2N+x−1 pixel points in a row, the display panel can display an image with higher resolution without increasing the pixel density of the display panel. In addition, in the display method according to the present embodiment, realization of displaying an image with higher resolution does not rely on increase in pixel density of a display panel, which will not result in increased output lines of a driving chip of the display panel or increased manufacturing cost of the display panel.

As shown in FIG. 2, the display panel may comprise at least two rows of pixel units 1, and the number of pixel units 1 in each row is at least two, i.e., M≥2 and N≥2. In addition, a plurality of sub-pixels in the same column are aligned in the column direction, which facilitates fabrication of the display panel. In this case, the two pixel points 2 corresponding to the sub-pixel $A_y$ in the pixel unit 1 in column n may be the pixel point 2 in column 2n+y−2 and the pixel point 2 in column 2n+y−1, respectively, wherein, 1≤n≤N and 1≤y≤x.

In fact, such correspondence has been described with reference to FIG. 3. As shown in FIG. 3, in the pixel units 1 in each row, the red sub-pixel A1 in the pixel unit 1 in the first column corresponds to the first and second pixel points 2, the green sub-pixel A2 corresponds to the second and third pixel points 2, and the blue sub-pixel A3 corresponds to the third and fourth pixel points 2; the red sub-pixel A1 in the pixel unit 1 in the second column corresponds to the third and fourth pixel points 2, the green sub-pixel A2 corresponds to the fourth and fifth pixel points 2, and the blue sub-pixel A3 corresponds to the fifth and sixth pixel points 2; and so on. It can be easily understood that, in this case, the pixel points 2 corresponding to the respective row of pixel units 1 are aligned in the column direction, that is, an image S that can be displayed by the display panel has M rows and 2N+x−1 columns of pixel points 2.

Figure 4:
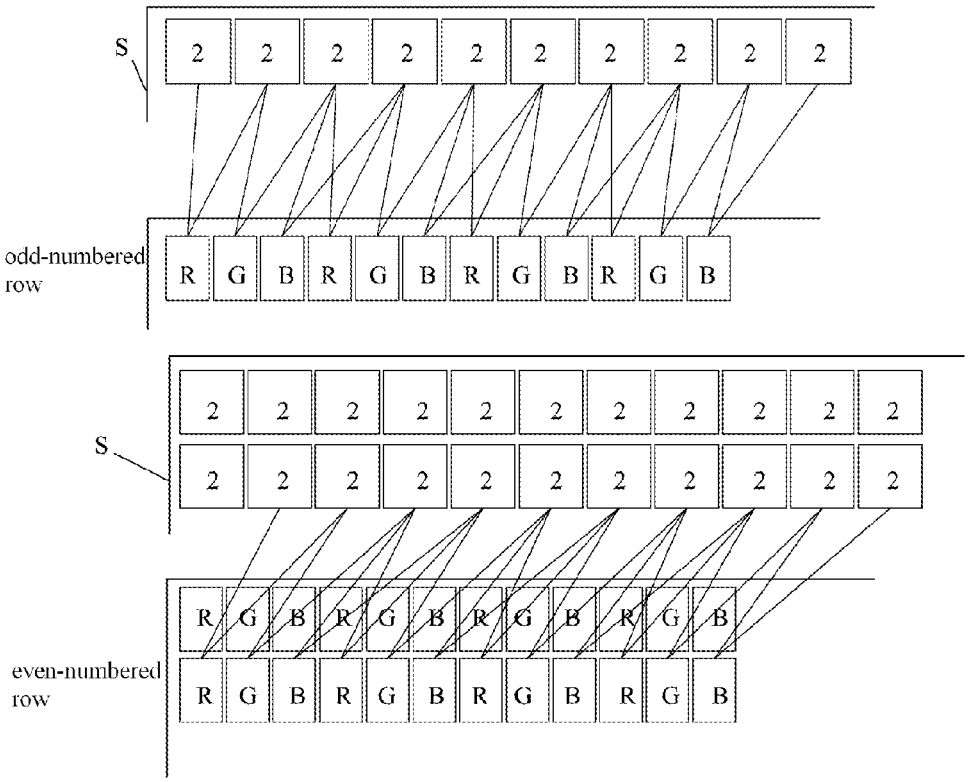
FIG. 4 is a schematic diagram illustrating that pixel points corresponding to sub-pixels in an odd-numbered row and pixel points corresponding to sub-pixels in an even-numbered row are staggered with each other.

Alternatively, under a situation in which M≥2 and N≥2, the pixel points 2 corresponding to the pixel units 1 in different rows may be staggered in the column direction. FIG. 4 is a schematic diagram illustrating that pixel points corresponding to sub-pixels in an odd-numbered row and pixel points corresponding to sub-pixels in an even-numbered row are staggered with each other.

As shown in FIG. 4, in an odd-numbered row, the two pixel points 2 corresponding to the sub-pixel $A_y$ in the pixel unit 1 in column n may be the pixel point 2 in column 2n+y−2 and the pixel point 2 in column 2n+y−1; in an even-numbered row, the two pixel points 2 corresponding to the sub-pixel $A_y$ in the pixel unit 1 in column n may be the pixel point 2 in column 2n+y−2+t and the pixel point 2 in column 2n+y−1+t, wherein 1≤n≤N, 1≤y≤x and t≥1. That is, in an odd-numbered row and an even-numbered row, the pixel points 2 corresponding to the sub-pixels in the pixel unit 1 in the same column are staggered, in the column direction, by t pixel points 2. In the example shown in FIG. 4, t=1.

It can be known from the above that, in an odd-numbered row and an even-numbered row, the pixel points 2 corresponding to the sub-pixels in the pixel unit 1 in the same column are not aligned but staggered by t pixel points 2. Therefore, in this case, if the pixel points 2 that can be displayed by the N pixel units 1 in an odd-numbered row are the first to the (2N+x−1)th pixel points 2, the pixel points 2 that can be displayed by the N pixel units in an even-numbered row are the second to the (2N+x)th pixel points 2. Thus, in the present embodiment, an image that can be displayed by the display panel may have M rows and 2N+x columns of pixel points. Compared to the above embodiment, the display method according to the present embodiment can additionally display t columns of pixel points 2, and can thus display an image S with higher resolution.

Of course, in the present embodiment, the arrangement manners of an odd-numbered row and an even-numbered row may be exchanged, that is, in an even-numbered row, the two pixel points 2 corresponding to the sub-pixel $A_y$ in the pixel unit 1 in column n may be the pixel point 2 in column 2n+y−2 and the pixel point 2 in column 2n+y−1; in an odd-numbered row, the two pixel points 2 corresponding to the sub-pixel $A_y$ in the pixel unit 1 in column n may be the pixel point 2 in column 2n+y−2+t and the pixel point 2 in column 2n+y−1+t, wherein 1≤n≤N, 1≤y≤x and t≥1.

Figure 5:
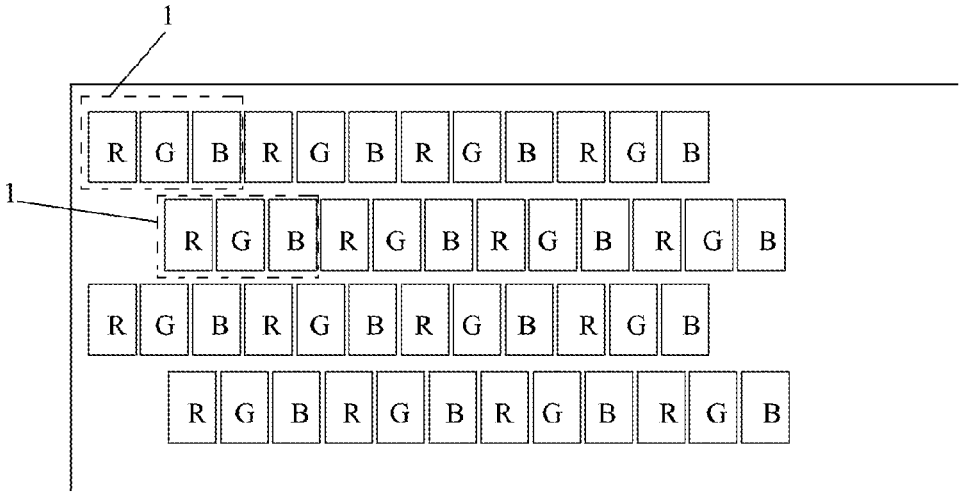
FIG. 5 is a schematic diagram illustrating a first mode in which sub-pixels in an odd-numbered row and sub-pixels in an even-numbered row are arranged in a staggered manner.
Figure 6:
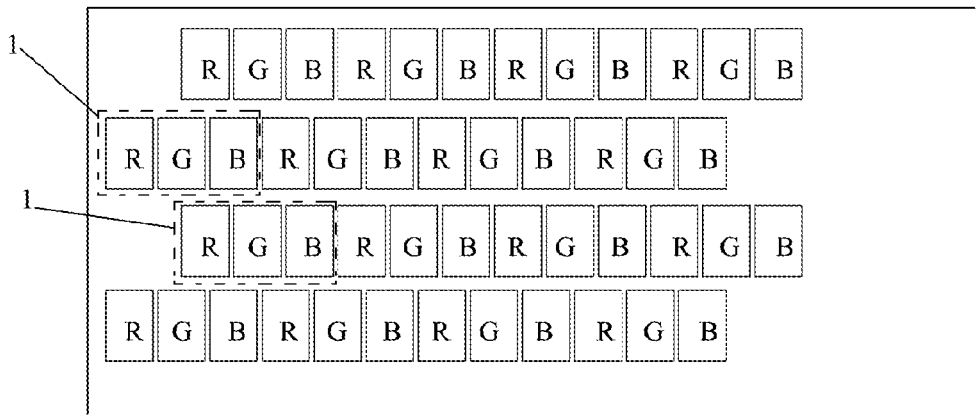
FIG. 6 is a schematic diagram illustrating a second mode in which sub-pixels in an odd-numbered row and sub-pixels in an even-numbered row are arranged in a staggered manner.

According to another embodiment of the present invention, a plurality of sub-pixels in the same column in the odd-numbered rows are aligned in the column direction, a plurality of sub-pixels in the same column in the even-numbered rows are aligned in the column direction, and the sub-pixels in the same column in any two adjacent rows are staggered in the column direction. FIGS. 5 and 6 are schematic diagrams illustrating two modes in which sub-pixels in an odd-numbered row and sub-pixels in an even-numbered row are arranged in a staggered manner.

As shown in FIGS. 5 and 6, the sub-pixels in the odd-numbered rows are staggered with those in the even-numbered rows, in the column direction, so that the sub-pixels in the odd-numbered rows and even-numbered rows are aligned, in the column direction, with the pixel points 2 which are arranged in a staggered manner (the embodiment shown in FIG. 4), and thus occurrence of deviation is avoided when the display panel displays an image S. According to an embodiment of the present invention, the sub-pixels in the same column in any two adjacent rows may be staggered, in the column direction, by ½ the width of the pixel unit 1, as shown in FIGS. 5 and 6. In this case, a spare region at a side of an even-numbered row between two adjacent odd-numbered rows is provided with a supplementary display unit, and/or, a spare region at a side of an odd-numbered row between two adjacent even-numbered rows may be provided with a supplementary display unit (not shown in FIGS. 5 and 6), and the supplementary display unit may comprise one or more sub-pixels. The supplementary display unit may be configured to display a component, which is not displayed, in the pixel point 2, which is not completely displayed, corresponding to each pixel unit 1.

Generally, each pixel point in the image S is square, in the prior art, each pixel unit, which typically comprises a red sub-pixel, a green sub-pixel and a blue sub-pixel arranged in the row direction, is configured to display one pixel point, and therefore, in the prior art, aspect ratio of each sub-pixel in the pixel unit is 3:1. According to an embodiment of the present invention, since each sub-pixel correspondingly displays components having the same color as the sub-pixel in two pixel points 2, in the embodiment of the present invention, the aspect ratio of each sub-pixel is 3:2, so as to achieve the same effect as the prior art of displaying one pixel point by one pixel unit.

Figure 7:
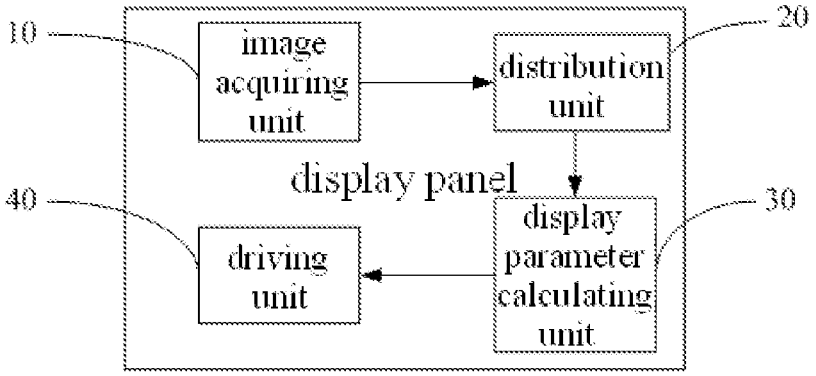
FIG. 7 is a schematic diagram of a display panel according to an embodiment of the present invention.

FIG. 7 is a schematic diagram of a display panel according to an embodiment of the present invention.

As shown in FIG. 7, the display panel comprises a plurality of pixel units arranged in M rows and N columns, each pixel unit comprises x sub-pixels $A_1$~$A_x$ having different colors, and M, N and x satisfy M≥1, N≥1 and x≥3, respectively. As shown in FIG. 7, the display panel further comprises an image acquiring unit 10, a distribution unit 20, a display parameter calculating unit 30 and a driving unit 40. The image acquiring unit 10 is configured to acquire an image, each row of the image has 2N+x−1 pixel points, each of which comprises x components having different colors, and the x colors are the same colors as those of the x sub-pixels $A_1$~$A_x$, respectively. The distribution unit 20 is configured to distribute the 2N+x−1 pixel points in each row to the sub-pixels in the same row of N pixel units in the display panel such that each sub-pixel corresponds to at most two pixel points, any two sub-pixels having the same color correspond to different pixel points, the sub-pixels having the same color in any two adjacent pixel units correspond to four consecutive pixel points, and in each pixel unit, any two adjacent sub-pixels share one pixel point to which both of said two adjacent sub-pixels correspond. The display parameter calculating unit 30 is configured to determine a display parameter of each sub-pixel according to the components, which have the same color as the sub-pixel, in the pixel points corresponding to the sub-pixel. The driving unit 40 is configured to input a driving signal to each sub-pixel such that each sub-pixel displays according to the display parameter determined by the display parameter calculating unit 30.

In the display panel according to the present embodiment, the N pixel units in each row can display the image having 2N+x−1 pixel points in one row, and thus the display panel can display an image with higher resolution without increasing the pixel density of the display panel. In addition, since the pixel density of the display panel is not increased, output lines of a driving chip of the display panel will not be increased due to displaying of an image with higher resolution, which will not result in increased manufacturing cost of the display panel.

According to an embodiment of the present invention, there is further provided a display device, which comprises the display panel according to the embodiment of the present invention.

It could be understood that, the above embodiments are merely exemplary embodiments adopted for describing the principle of the present invention, rather than limiting the present invention. For those of ordinary skill in the art, various modifications and improvements may be made without departing from the spirit and essence of the present invention, and these modifications and improvements are regarded as within the protection scope of the present invention.

The invention claimed is:

1. A display method of a display panel, the display panel comprising a plurality of pixel units arranged in M rows and N columns, each pixel unit comprising x sub-pixels $A_1 \sim A_x$ with different colors, wherein M, N and x satisfy $M \geq 1$, $N \geq 1$ and $x \geq 3$, respectively, the display method enables each row of N pixel units in the display panel to display an image having 2N+x−1 pixel points, and the display method comprises steps of:

S1, acquiring an image to be displayed having M rows and 2N+x−1 columns of pixel points, each row of which comprises 2N+x−1 pixel points corresponding to the N pixel units, wherein each pixel point comprises x components having different colors, and the x colors are the same colors as those of the x sub-pixels $A_1 \sim A_x$, respectively; and S2, determining a display parameter of each sub-pixel according to the components, which have the same color as the sub-pixel, in the pixel points corresponding to the sub-pixel, wherein, the pixel points corresponding to each sub-pixel are two adjacent pixel points in the acquired image, any two sub-pixels having the same color correspond to different pixel points, the sub-pixels having the same color in any two adjacent pixel units correspond to four consecutive pixel points, and in each pixel unit, any two adjacent sub-pixels share one pixel point to which both of said two adjacent sub-pixels correspond.

2. The display method of a display panel according to claim 1, wherein, $M \geq 2$, $N \geq 2$, and a plurality of sub-pixels in the same column are aligned in a column direction.

3. The display method of a display panel according to claim 2, wherein, the two pixel points corresponding to the sub-pixel $A_y$ in the pixel unit in column n are the pixel point in column 2n+y−2 of the image to be displayed and the pixel point in column 2n+y−1 of the image to be displayed, respectively, wherein, $1 \leq n \leq N$ and $1 \leq y \leq x$.

4. The display method of a display panel according to claim 1, wherein, $M \geq 2$, $N \geq 2$, in an odd-numbered row, the two pixel points corresponding to the sub-pixel $A_y$ in the pixel unit in column n are the pixel point in column 2n+y−2 of the image to be displayed and the pixel point in column 2n+y−1 of the image to be displayed, respectively, and in an even-numbered row, the two pixel points corresponding to the sub-pixel $A_y$ in the pixel unit in column n are the pixel point in column 2n+y−2+t of the image to be displayed and the pixel point in column 2n+y−1+t of the image to be displayed, respectively; or, in an even-numbered row, the two pixel points corresponding to the sub-pixel $A_y$ in the pixel unit in column n are the pixel point in column 2n+y−2 of the image to be displayed and the pixel point in column 2n+y−1 of the image to be displayed, respectively, and in an odd-numbered row, the two pixel points corresponding to the sub-pixel $A_y$ in the pixel unit in column n are the pixel point in column 2n+y−2+t of the image to be displayed and the pixel point in column 2n+y−1+t of the image to be displayed, respectively, wherein, $1 \leq n \leq N$, $1 \leq y \leq x$ and $t \geq 1$.

5. The display method of a display panel according to claim 4, wherein, a plurality of sub-pixels in the same column in odd-numbered rows are aligned in a column direction, a plurality of sub-pixels in the same column in even-numbered rows are aligned in the column direction, and the sub-pixels in the same column in any two adjacent rows are staggered in the column direction.

6. The display method of a display panel according to claim 5, wherein, the sub-pixels in the same column in any two adjacent rows are staggered, in the column direction, by ½ width of the pixel unit.

7. The display method of a display panel according to claim 6, wherein, a spare region at a side of the even-numbered row between two adjacent odd-numbered rows is provided with a supplementary display unit, and/or, a spare region at a side of the odd-numbered row between two adjacent even-numbered rows is provided with a supplementary display unit, wherein, the supplementary display unit comprises one or more sub-pixels.

8. The display method of a display panel according to claim 1, wherein, aspect ratio of each sub-pixel is 3:2.

9. A display panel, comprising a plurality of pixel units arranged in M rows and N columns, each pixel unit comprising x sub-pixels $A_1 \sim A_x$ with different colors, and M, N and x satisfying $M \geq 1$, $N \geq 1$ and $x \geq 3$, respectively, the display panel further comprising an image acquiring unit, a distribution unit, a display parameter calculating unit and a driving unit, wherein, the image acquiring unit is configured to acquire an image to be displayed having M rows and 2N+x−1 columns of pixel points, each row of the image to be displayed has 2N+x−1 pixel points, each of which comprises x components having different colors, and the x colors are the same colors as those of the x sub-pixels $A_1 \sim A_x$, respectively, the distribution unit is configured to distribute the 2N+x−1 pixel points in each row to the sub-pixels in the same row of N pixel units in the display panel such that each sub-pixel corresponds to two pixel points, any two sub-pixels having the same color correspond to different pixel points, the sub-pixels having the same color in any two adjacent pixel units correspond to four consecutive pixel points, and in each pixel unit, any two adjacent sub-pixels share one pixel point to which both of said two adjacent sub-pixels correspond, the display parameter calculating unit is configured to determine a display parameter of each sub-pixel according to the components, which have the same color as the sub-pixel, in the pixel points corresponding to the sub-pixel, and the driving unit is configured to input a driving signal to each sub-pixel such that each sub-pixel displays according to the display parameter determined by the display parameter calculating unit.

10. The display panel according to claim 9, wherein, $M \geq 2$, $N \geq 2$, and a plurality of sub-pixels in the same column are aligned in a column direction.

11. The display panel according to claim 10, wherein, the two pixel points corresponding to the sub-pixel $A_y$ in the pixel unit in column n are the pixel point in column 2n+y−2 of the image to be displayed and the pixel point in column 2n+y−1 of the image to be displayed, respectively, wherein, $1 \leq n \leq N$ and $1 \leq y \leq x$.

12. The display panel according to claim 9, wherein, $M \geq 2$, $N \geq 2$, in an odd-numbered row, the two pixel points corresponding to the sub-pixel $A_y$ in the pixel unit in column n are the pixel point in column $2n+y-2$ of the image to be displayed and the pixel point in column $2n+y-1$ of the image to be displayed, respectively, and in an even-numbered row, the two pixel points corresponding to the sub-pixel $A_y$ in the pixel unit in column n are the pixel point in column $2n+y-2+t$ of the image to be displayed and the pixel point in column $2n+y-1+t$ of the image to be displayed, respectively; or, in an even-numbered row, the two pixel points corresponding to the sub-pixel $A_y$ in the pixel unit in column n are the pixel point in column $2n+y-2$ of the image to be displayed and the pixel point in column $2n+y-1$ of the image to be displayed, respectively, and in an odd-numbered row, the two pixel points corresponding to the sub-pixel $A_y$ in the pixel unit in column n are the pixel point in column $2n+y-2+t$ of the image to be displayed and the pixel point in column $2n+y-1+t$ of the image to be displayed, respectively, wherein, $1 \leq n \leq N$, $1 \leq y \leq x$ and $t \geq 1$.

13. The display panel according to claim 12, wherein, a plurality of sub-pixels in the same column in odd-numbered rows are aligned in a column direction, a plurality of sub-pixels in the same column in even-numbered rows are aligned in the column direction, and the sub-pixels in the same column in any two adjacent rows are staggered in the column direction.

14. The display panel according to claim 13, wherein, the sub-pixels in the same column in any two adjacent rows are staggered, in the column direction, by ½ width of the pixel unit.

15. The display panel according to claim 14, wherein, a spare region at a side of the even-numbered row between two adjacent odd-numbered rows is provided with a supplementary display unit, and/or, a spare region at a side of the odd-numbered row between two adjacent even-numbered rows is provided with a supplementary display unit, wherein, the supplementary display unit comprises one or more sub-pixels.

16. The display panel according to claim 9, wherein, aspect ratio of each sub-pixel is 3:2.

17. A display device, comprising the display panel according to claim 9.

18. The display device according to claim 17, wherein, $M \geq 2$, $N \geq 2$, and a plurality of sub-pixels in the same column are aligned in a column direction.

19. The display device according to claim 18, wherein, the two pixel points corresponding to the sub-pixel $A_y$ in the pixel unit in column n are the pixel point in column $2n+y-2$ of the image to be displayed and the pixel point in column $2n+y-1$ of the image to be displayed, respectively, wherein, $1 \leq n \leq N$ and $1 \leq y \leq x$.

20. The display device according to claim 17, wherein, $M \geq 2$, $N \geq 2$, in an odd-numbered row, the two pixel points corresponding to the sub-pixel $A_y$ in the pixel unit in column n are the pixel point in column $2n+y-2$ of the image to be displayed and the pixel point in column $2n+y-1$ of the image to be displayed, respectively, and in an even-numbered row, the two pixel points corresponding to the sub-pixel $A_y$ in the pixel unit in column n are the pixel point in column $2n+y-2+t$ of the image to be displayed and the pixel point in column $2n+y-1+t$ of the image to be displayed, respectively; or, in an even-numbered row, the two pixel points corresponding to the sub-pixel $A_y$ in the pixel unit in column n are the pixel point in column $2n+y-2$ of the image to be displayed and the pixel point in column $2n+y-1$ of the image to be displayed, respectively, and in an odd-numbered row, the two pixel points corresponding to the sub-pixel $A_y$ in the pixel unit in column n are the pixel point in column $2n+y-2+t$ of the image to be displayed and the pixel point in column $2n+y-1+t$ of the image to be displayed, respectively, wherein, $1 \leq n \leq N$, $1 \leq y \leq x$ and $t \geq 1$.

* * * * *